US005626500A

United States Patent [19]

Yoshimura

[11] Patent Number: 5,626,500

[45] Date of Patent: May 6, 1997

[54] CONTACT AND CONNECTOR

[75] Inventor: Yohji Yoshimura, Yokohama, Japan

[73] Assignee: The Whitaker Corporation, Wilmington, Del.

[21] Appl. No.: 418,053

[22] Filed: Apr. 6, 1995

[30] Foreign Application Priority Data

May 30, 1994 [JP] Japan ..... 6-116866

[51] Int. Cl.[6] ..... H01R 4/48

[52] U.S. Cl. ..... 439/862; 439/74; 439/637

[58] Field of Search ..... 439/74, 637, 660, 439/862

[56] References Cited

U.S. PATENT DOCUMENTS

| | | | |
|---|---|---|---|
| 3,120,988 | 2/1964 | Gilbert | 439/637 X |
| 3,464,054 | 8/1969 | Mansfield | 439/637 |
| 3,660,803 | 5/1972 | Cooney | 439/637 |
| 3,718,885 | 2/1973 | Dorjee et al. | 439/862 X |
| 4,077,694 | 3/1978 | Cobaugh et al. | 439/637 X |
| 4,168,879 | 9/1979 | Ohtsuki et al. | 439/862 |

FOREIGN PATENT DOCUMENTS

| | | |
|---|---|---|
| 60-62780 | 5/1985 | Japan . |
| 07263091A | 10/1995 | Japan . |

*Primary Examiner*—Jes F. Pascua

[57] ABSTRACT

A contact 10, which can be easily made in small sizes, has a contacting section 12 with a double curvature bend 18,20 at one end, and a termination section 16 at the other end. A main body section 14 is between the contacting section 12 and the termination section 16 which has protrusions 28*a* and 28*b* located near the contacting section 12 and on the opposite side of it. These protrusions 28*a* and 28*b* form a gap between the main body section 14 and the housing wall of a connector housing, thus increasing the springiness of the contacting section 12 as compared to other contacts of the same size.

16 Claims, 2 Drawing Sheets

CONTACT AND CONNECTOR

FIELD OF INVENTION

This invention relates to female contacts for receiving male contacts and the connectors in which such contacts are arranged.

BACKGROUND OF THE INVENTION

It is known for female electrical contacts to be arranged in a plug housing for receiving male electrical contacts arranged in a cap housing. In order to provide for reliable electrical contact between the female and male contacts, it is desirable that the female contacts exert a contacting force on the male contacts they are retaining. In many cases, this is accomplished by spring-loading the female contacts. One of the designs based on such a method comprises a pair of flat springs connected at their rear end with one spring having a fulcrum at its mid-point and the other one being of a variable displacement in order to provide the high contacting force as disclosed in Japanese Utility Model Publication No. 85-62780. However, the female contacts of such a design are difficult to reduce in size because of the pair of springs having a fulcrum which is a complicated configuration.

Another type of female contact has been offered which can be manufactured by stamping one flat strip and making a double curve at its end which serves as a spring-loaded contacting section as disclosed in Japanese Utility Model Publication No. 94-50451. Because the design of such a contact is simple, it was suitable for use in small-size connectors. An additional advantage of such a design was that the double curve could provide a high contacting force. However to get a high contacting force from such a spring-loaded contact there must be long length between the point of contact with the male contact and the spring's fulcrum. Due to the long length needed, the amount of contacting US force is limited when this design is reduced to a small-sized device because of the fact that the length of the female contact is limited.

Considering the aforementioned female contact designs, the objective of this invention is to offer a female contact whose spring-loaded member can provide a high contacting force even at small sizes and a connector for using such contacts.

SUMMARY OF THE INVENTION

In order to achieve the above stated objective, the present invention discloses a female contact having a contacting section with a double curvature bend at one end, a main body section and a termination section at the other end. Between the contacting section and the termination section, protrusions are located near the contacting section on the main body section. These protrusions form a gap between the main body section and the housing wall of the connector housing, thus increasing the springiness of the contacting section and allowing the contact to be manufactured easily in a smaller size.

BRIEF DESCRIPTION OF THE DRAWINGS

An embodiments of the invention will now be described by way of example with reference to the accompanying drawings in which.

DETAILED DESCRIPTION OF THE INVENTION

Figure 1:
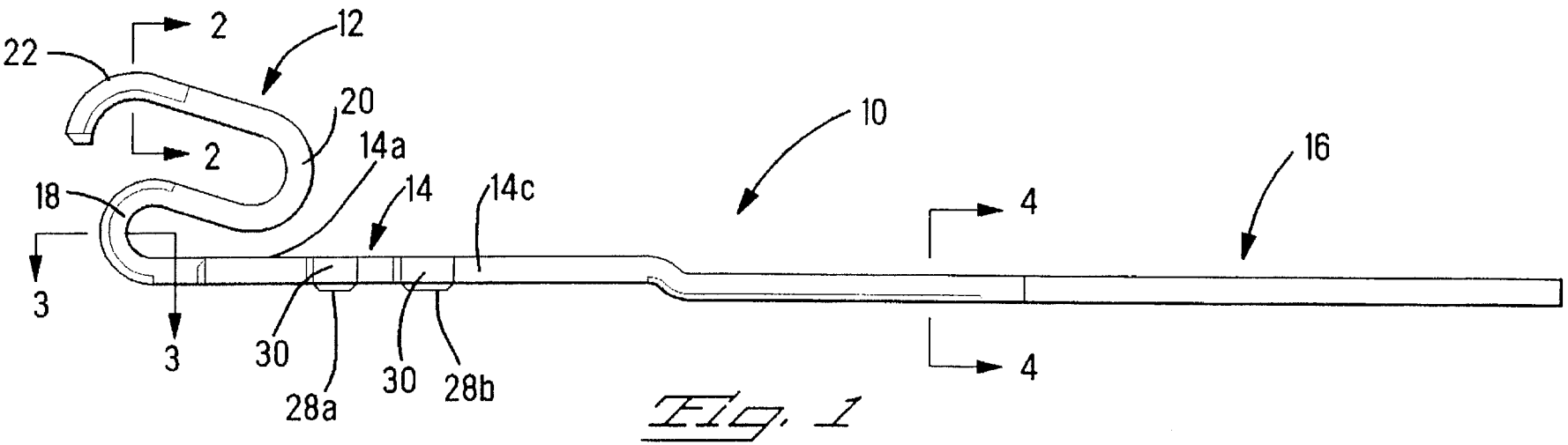
FIG. 1 is a side view of an embodiment of a female contact according to this invention.
Figure 4:
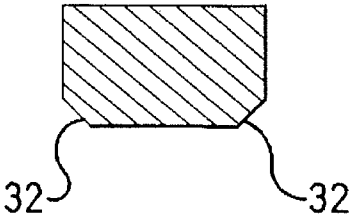
FIG. 4 is a cross-sectional view taken along line 4—4 in FIG. 1.

The female contact of the present invention comprises a flat main body section elongated in the direction of connection. It has at least one protrusion formed on one of its surfaces and a contacting section for making contact with a male contact. The contacting section comprises a first curved section connected to one end of the main body section and bent from that end in the direction opposite the side with the protrusion and towards the other end of the main body section, and a second curved section connected to the front end of the first curved section and bent back in the opposite direction of the first bend.

The connector of the present invention comprises a housing and the aforementioned female contacts arranged in the housing to form electrical contact with male contacts of a mating connector. The protrusion or protrusions extend from the main body section of the female contact against the housing wall when the contacts are arranged in the housing. There is a gap formed between the housing wall and the main body section of the female contact such that contacting section of the main body is separated from the housing wall and can be flexed using the protrusion as a fulcrum, thus imparting springiness to the main body section. In addition to the protrusion, the first and the second curved sections provide resilience.

The protrusion makes it possible to increase the contacting force compared to a contact having only two curved sections and can be easily manufactured as part of a small-sized female contact without limiting the contacting force applied to the male contact. It is desirable that the height of the protrusion is between 20% and 40% of the thickness of the sheet material from which the female contact is manufactured. The preferable height is 30% of the thickness of the sheet material. If the height of the protrusion is less than 20% of the thickness of the material, the distance of the main body section from the housing wall will be too small, thus reducing the amount of flexing and result in insufficient springiness of the female contact. On the other hand, if the height of the protrusion is more than 40% of the thickness of the material, the springiness will be higher than is required. Therefore, it is desirable that the height of the protrusions is more than 20% but less than 40% of the thickness of material. It is also desirable to have a protrusion positioned on the main body near the second curved section because the female contact will have a higher degree of springiness, thus providing a high contacting force on the male contacts and making it possible to obtain a reliable electrical connection.

An embodiment of the present invention is shown in FIGS. 1–6. The female contact 10 of FIG. 1 comprises a contacting section 12 that forms a connection with a male contact (not shown), a main body section 14 which is to be attached to the housing, and a termination section 16 provided for connection to printed circuits or printed circuit boards. In the state shown in FIG. 1, the length of the female contact 10 is about 8.5 mm, and the thickness of the main body section is about 0.15 mm.

Figure 3:
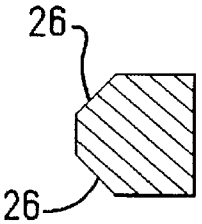
FIG. 3 is a cross-sectional view taken along line 3—3 in FIG. 1.
Figure 2:
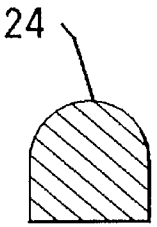
FIG. 2 is a cross-sectional view taken along line 2—2 in FIG. 1.

The contacting section 12 is formed by a first curved section 18 originating from one end of the main body section 14 and bent in the direction opposite of protrusions 28*a*, 28*b* and towards a termination section 16, and a second curved section 20 bent opposite the first bend starting from the front end of the first curved section 18. Because of these two curved sections 18 and 20, the female contact 10 possesses a high resiliency. The front end 22 of the second curved section 20 is bent downward in order to facilitate the insertion of a male contact. In addition, as can be seen from FIG. 2, front end 22 has a rounded surface 24 to provide for a smooth engagement with a male contact. Due to this rounded surface 24, the engagement with the male contact is of a linear nature, thus making the contacting force even higher. The shape of the cross section of the first curved section 18 as shown in FIG. 3 has two slanted surfaces 26 in order to facilitate the insertion of the contact 10 into the housing.

Figure 5:
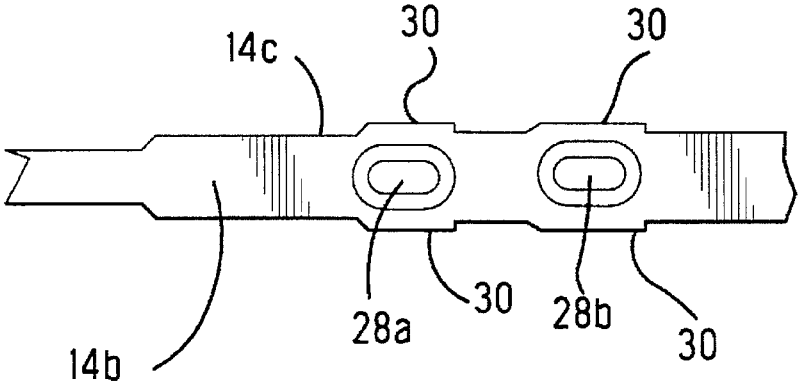
FIG. 5 is an enlarged bottom view of the protrusions shown in FIG. 1. US
Figure 6:
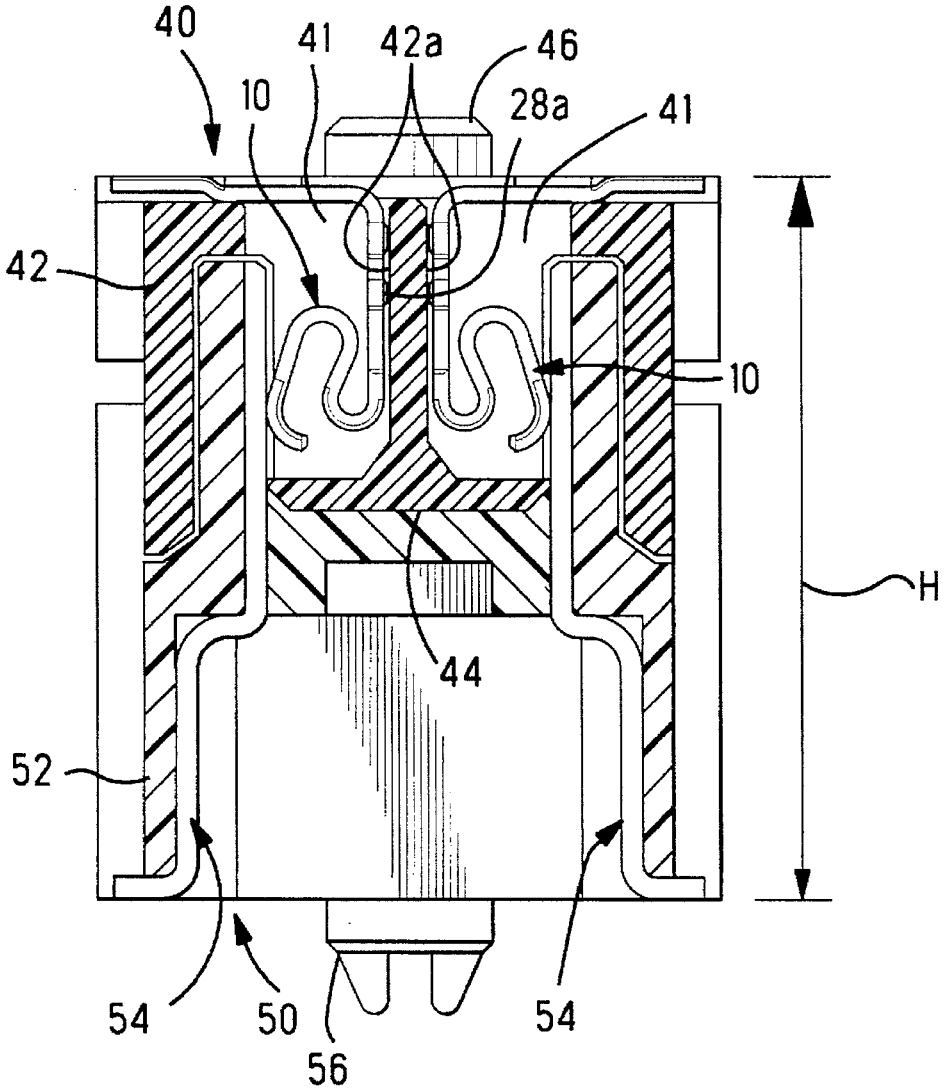
FIG. 6 is a cross-sectional view showing a connector assembly with female contacts of FIG. 1 arranged in a housing that is mated to a mating housing having male contacts.

On one surface 14*b* of the main body section 14, two protrusions 28*a*, 28*b* are formed, and on each side surface 14*c*, two barbs 30 are provided as shown in FIGS. 1 and 5. The protrusions 28*a*, and 28*b* are made by punching and knocking them out. When the female contact 10 is inserted in the housing, the barbs 30 cut into the inside walls of the housing and secure the contact 10 in the housing (FIG. 6). The protrusions 28*a*, 28*b* engage against the inside wall of the housing, thus forming a gap between the surface 14*b* of the female contact and the inside wall. Because of this gap, the main body section 14 possesses certain springiness and can flex when male contacts are inserted in the housing in engagement with the female contacts 10. In order to obtain the appropriate springiness and the appropriate flexing amplitude, the protrusion 28*a*, is located near the second curved section 20. Generally, there is just one protrusion, but in this embodiment there are two. In this case, the height of the protrusions is 0.05 mm, which corresponds to 33% at the thickness of the main body section 14 of 0.15 mm. The other end of the main body section 14, as shown in the FIG. 4 has chamfered surfaces 32 for the purposes of stress relief.

An explanation of the process of production of the above mentioned female contact 10 embodiment follows. First, on a flat sheet metal, protrusions 28*a*, and 28*b* are punched out before the female contact 10 is stamped out. Then, the half-finished flat female contact 10 is stamped out. Next, the contacting section 12 is formed on the flat stamped out female contact 10, and the entire contact is nickel plated. After nickel plating, the contact is suspended with the contacting section 12 down, and the contacting section 12 is gold plated. After that, the termination section 16 is tinned in order to improve its soldering characteristics. After the tinning, the termination section 16 is bent to the required shape. During the tinning process, it is necessary to pay special attention that the gold-plated portion is not submerged in the tinning bath to prevent soiling of the tinning bath. For this purpose, a 1.5–2.0 mm wide border between the gold-plated portion and tinned portion is formed since the gold plating of the contacting section 12 is done after it has been bent, special care must be taken that the gold-plated area is not overlapped with the area to be tinned. There is always a danger with conventional contacts that the gold-plated area of the contacts will be submerged in the tinning bath because the contacting section is longer and the main body section is shorter in order to impart a high springiness. Therefore, this operation requires special attention. However, the female contact 10 of the present invention, as described above, has a contacting section that is shorter than that of a conventional design and therefore the main body section can be made longer which makes the plating process much easier.

Next, an embodiment of a connector according to this invention with reference to drawings will be explained. FIG. 6 is a cross section showing a plug connector with the female contacts arranged in it connected with a cap connector having male contacts.

Female contacts 10 of FIG. 1 in the plug connector 40 are arranged in cavity 41 of the housing 42 adjacent to an inside wall 42*a*. The connectors 40 and 50 are distinguished by their very small size with their stacked height H being only 7 mm. In addition, a flat surface 44 is provided in the plug connector 40 which is oriented perpendicularly to the joining direction. It is used for the placement of the plug connector 40 by applying the nozzle of a vacuum pump (not shown) to the flat surface 44. In a connector without such a flat surface 44, the springiness of the main body section can be achieved by making protrusions on the inner walls of the housing instead of the protrusions being made in the main body section 14 (see FIG. 1). In this embodiment of the plug connector 40, the advantages of having the flat surface 44 and a high springiness of the female contact are present. The housing 42 of the plug connector 40 also has a boss 46 for proper positioning on a circuit board, and the housing 52 of the cap connector 50 has retention legs 56 for temporary securing the connector to the circuit board.

As follows from the above disclosure, the female contact according to this invention has protrusions and two curved sections which impart a high springiness to the female contact which results in a high contacting force. Due to a comparatively simple design, it is easy to manufacture the female contacts to a very small size. The connector according to this invention has the aforementioned female contacts which exert a high contacting force on the male contacts of a mating connector thereby providing a reliable electrical connection.

I claim:

1. An electrical contact comprising:

a main body section;

a contacting section extending from one end of said main body section for making contact with a mating contact, said contacting section including a first curved section extending from a front end of the main body section defining a first bend extending in a direction towards a rear end of the main body section, and a second curved section extending from said first curved section defining a second bend extending in an opposite direction of said first bend, said first curved section having a cross section with slanted surfaces to facilitate the engagement with a mating contact; and at least one protrusion on said main body section said protrusion defining a fulcrum enhancing the flexibility of said contacting section upon engagement by the mating contact.

2. The electrical contact of claim 1, wherein said main body section includes a plurality of protrusions.

3. An electrical contact of claim 1, wherein barbs are provided on said main body section to engage a connector housing.

4. The electrical contact of claim 1, wherein a front end of said contacting section extending from said second curved section defines a third bend extending downwardly to facilitate engagement with the mating contact.

5. An electrical contact of claim 1, wherein a termination section extends from a end of the main body section opposite the end from which the contacting section extends.

6. An electrical contact of claim 1, wherein a portion of the main body section opposite the end from which the contacting section extends has chamfered surfaces for the purpose of stress relief.

7. The electrical connector of claim 1, wherein said main body section includes a plurality of protrusions.

8. An electrical contact comprising:

a main body section;

a contacting section extending from one end of said main body section for making contact with a mating contact; and at least one protrusion on said main body section, said protrusion defining a fulcrum enhancing the flexibility of said contacting section upon engagement by the mating contact, said protrusion having a height equal to between 20% and 40% of the thickness of sheet material from which said electrical contact is formed.

9. The electrical contact of claim 8, wherein said main body section includes a plurality of protrusions.

10. The electrical contact of claim 8, wherein barbs are provided on said main body section to engage a connector housing.

11. An electrical connector comprising:

a dielectric housing having a cavity; and an electrical contact mounted in said housing adjacent to an inside wall in said cavity comprising a main body section, a contacting section extending from one end of said main body section that is displaced into said cavity for electrical engagement with a mating contact, and at least one protrusion provided between said main body section and said inside wall and defining a gap between said inside wall and said electrical contact thereby separating said contacting section from said inside wall, said protrusion having a height equal to between 20% and 40% of the thickness of sheet material from which said electrical contact is formed, said protrusion defining a fulcrum enhancing the flexibility of said contacting section upon engagement by the mating contact.

12. An electrical connector of claim 11, wherein a termination section extends from an end of the main body section opposite the end from which the contacting section extends.

13. The electrical connector of claim 11, wherein said dielectric housing has a flat surface to allow for the application of a vacuum pump nozzle for placement of the electrical connector on a circuit board.

14. An electrical connector comprising:

a dielectric housing having a cavity; and an electrical contact mounted in said housing adjacent to an inside wall in said cavity comprising a main body section, a contacting section extending from one end of said main body section that is displaced into said cavity for electrical engagement with a mating contact, said contacting section including a first curved section extending from a front end of the main body section defining a first bend extending in a direction towards a rear end of the main body section, and a second curved section extending from said first curved section defining a second bend extending in an opposite direction of said first bend, said first curved section having a cross section with slanted surfaces to facilitate the engagement with a mating contact; and at least one protrusion provided between said main body section and said inside wall and defining a gap between said inside wall and said electrical contact thereby separating said contacting section from said inside wall, said protrusion defining a fulcrum enhancing the flexibility of said contacting section upon engagement by the mating contact.

15. The electrical connector of claim 14, wherein said main body section includes a plurality of protrusions.

16. The electrical connector of claim 14, wherein said dielectric housing has a flat surface to allow for the application of a vacuum pump nozzle for placement of the electrical connector on a circuit board.

* * * * *